US005444919A

United States Patent [19]

Alves

[11] Patent Number: 5,444,919

[45] Date of Patent: Aug. 29, 1995

[54] BATTERY POWERED CHALK LINE SYSTEMS

[76] Inventor: Antonio D. Alves, 100 Pear St., Palmyra, N.J. 08065

[21] Appl. No.: 203,932

[22] Filed: Mar. 1, 1994

[51] Int. Cl.[6] ..... B44D 3/38

[52] U.S. Cl. ..... 33/414; 33/393; 33/339; 242/390.8

[58] Field of Search ..... 33/413, 414, 339, 756, 33/393, 394; 242/390.8, 390.9, 405, 395.1

[56] References Cited

U.S. PATENT DOCUMENTS

| | | | |
|---|---|---|---|
| 3,311,319 | 3/1967 | Campbell | 242/405 |
| 3,438,595 | 4/1969 | Brown et al. | 33/414 |
| 3,568,322 | 3/1971 | Showers | 33/393 |
| 3,784,125 | 1/1974 | Law et al. | 242/390.8 |
| 4,189,107 | 2/1980 | Quenot et al. | 242/390.9 |
| 4,272,036 | 6/1981 | Watermann | 242/405 |
| 4,697,349 | 10/1987 | Lee | 33/414 |
| 4,773,162 | 9/1988 | Lin | 33/414 |
| 4,813,145 | 3/1989 | Josey, Jr. et al. | 33/414 |
| 5,014,437 | 5/1991 | Sun | 33/414 |
| 5,212,875 | 5/1993 | Corso | 33/414 |

*Primary Examiner*—Thomas B. Will

[57] ABSTRACT

A battery powered chalk line comprising a housing having a top and bottom face and side walls forming a chamber therein. A drive shaft is secured within the side walls for rotational movement and extends across the width of the chamber. A spindle is mounted on the shaft and is selectively couplable for rotation therewith. A chalk line is mounted on the spindle for being dispensed and retrieved with the rotation of the shaft. The chalk line extends through an aperture in the front end of the housing with a hook secured to the exterior end of the line. A cavity in the chamber adjacent to its front end in proximity to the aperture for coating the line with chalk powder as the line passes therethrough. A driven bevel gear forms with the spindle for rotation therewith. A motor with an output shaft with drive bevel gear secures thereto for rotation to rotate the spindle to reel in the line. Batteries within the chamber couple the motor with a switch to activate and inactivate the motor. A handle is mounted to one end of the drive shaft exterior of the housing. The handle is movable to a first position locked with respect to the housing to allow rotation of the spindle through the motor independent of the drive shaft for the automatically reeling in the line and is movable to an operative position to couple the drive shaft with the spindle for manually reeling in the line.

4 Claims, 4 Drawing Sheets

BATTERY POWERED CHALK LINE SYSTEMS

BACKGROUND OF THE INVENTION

1. Field of the Invention

The present invention relates to battery powered chalk line systems and more particularly pertains to withdrawing and retracting a flexible line with respect to a housing.

2. Description of the Prior Art

The use of chalk line devices is known in the prior art. More specifically, chalk line devices heretofore devised and utilized for the purpose of automatically reeling in chalk lines after use are known to consist basically of familiar, expected, and obvious structural configurations, notwithstanding the myriad of designs encompassed by the crowded prior art which has been developed for the fulfillment of countless objectives and requirements.

By way of example, in U.S. Pat. No. 4,459,761 to Bosco discloses a retractable plumb and chalk line.

U.S. Pat. Nos. 4,565,011 to Karger and 4,813,145 to Josey, Jr., disclose automatically retractable chalk line assemblies.

U.S. Pat. No. 5,042,159 to Millen discloses a chalk line retraction device.

Lastly, U.S. Pat. No. 5,163,230 to Gast discloses a chalk line apparatus.

In this respect, the battery powered chalk line systems according to the present invention substantially departs from the conventional concepts and designs of the prior art, and in doing so provides an apparatus primarily developed for the purpose of withdrawing and retracting a flexible line with respect to a housing.

Therefore, it can be appreciated that there exists a continuing need for new and improved battery powered chalk line systems which can be used for withdrawing and retracting a flexible line with respect to a housing. In this regard, the present invention substantially fulfills this need.

SUMMARY OF THE INVENTION

In view of the foregoing disadvantages inherent in the known types of chalk line devices now present in the prior art, the present invention provides an improved battery powered chalk line systems. As such, the general purpose of the present invention, which will be described subsequently in greater detail, is to provide a new and improved battery powered chalk line systems and method which has all the advantages of the prior art and none of the disadvantages.

To attain this, the present invention essentially comprises a new and improved battery powered chalk line system comprising a housing formed of a rigid material having a top face, a bottom face and side walls as well as a front end and a rear end forming a chamber therein. A drive shaft is secured within the side walls for rotational movement and extends across the width of the chamber. A spindle is mounted on the shaft and is selectively couplable for rotation therewith. A chalk line is mounted on the spindle for being dispensed and retrieved with the rotation of the shaft. The chalk line extends through an aperture in the front end of the housing with a hook secured to the end of the line exterior of the housing. The hook is sized to preclude its movement into the housing. A cavity in the chamber is adjacent to the front end in proximity to the aperture for coating the line with chalk powder as the line is moved therethrough. A plug extends through a wall in the chamber for the filling of supplemental chalk after use. A driven bevel gear is formed with the spindle for rotation therewith. A motor with an output shaft with drive bevel gear is secured thereto for rotation to rotate the spindle to reel in the line. Batteries are located within the chamber and coupled to the motor with a switch coupled therebetween to activate and inactivate the motor at the discretion of the user. A handle is mounted to one end of the drive shaft exterior of the housing. The handle is movable to a first position locked with respect to the housing to allow rotation of the spindle through the motor independent of the drive shaft for automatically reeling in the line. The handle is movable to an operative position to couple the drive shaft with the spindle for manually reeling in the line. A bubble cartridge functions as a level mounted to the upper face of the housing to determine flatness of an adjacent surface. The bubble is located on the top side with a planar surface parallel with the bubble on the lower surface of the housing. A scribe element has a pointed end and a threaded end with a washer secured intermediate the extent of the threaded end and an associated recipient surface in the rear end of the housing for receiving the threads of the scribe element with the point extending either internally or externally.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved battery powered chalk line systems which have all the advantages of the prior art chalk line devices and none of the disadvantages.

It is another object of the present invention to provide new and improved battery powered chalk line systems which may be easily and efficiently manufactured and marketed.

It is further object of the present invention to provide new and improved battery powered chalk line systems which are of durable and reliable constructions.

An even further object of the present invention is to provide new and improved battery powered chalk line systems which are susceptible of a low cost of manufacture with regard to both materials and labor, and which accordingly are then susceptible of low prices of sale to the consuming public, thereby making such battery powered chalk line systems economically available to the buying public.

Still yet another object of the present invention is to provide new and improved battery powered chalk line systems which provide in the apparatuses and methods of the prior art some of the advantages thereof, while simultaneously overcoming some of the disadvantages normally associated therewith.

Still another object of the present invention is to withdrawing and retracting a flexible line with respect to a housing.

Lastly, it is an object of the present invention to provide new and improved battery powered chalk line system comprising a housing formed of a rigid material having a top face, a bottom face and side walls as well as a front end and a rear end forming a chamber therein. A drive shaft is secured within the side walls for rotational movement and extends across the width of the chamber. A spindle is mounted on the shaft and is selectively couplable for rotation therewith. A chalk line is mounted on the spindle for being dispensed and retrieved with the rotation of the shaft. The chalk line extends through an aperture in the front end of the housing with a hook secured to the end of the line exterior of the housing. The hook is sized to preclude its movement into the housing. A cavity in the chamber adjacent to the front end in proximity to the aperture for coating the line with chalk powder as the line is moved therethrough. A plug extends through a wall in the chamber for the filling of supplemental chalk after use. A driven bevel gear forms with the spindle for rotation therewith. A motor with an output shaft with drive bevel gear secures thereto for rotation to rotate the spindle to reel in the line. Batteries located within the chamber couple to the motor with a switch coupled therebetween to activate and inactivate the motor at the discretion of the user. A handle is mounted to one end of the drive shaft exterior of the housing. The handle is movable to a first position locked with respect to the housing to allow rotation of the spindle through the motor independent of the drive shaft for the automatically reeling in the line. The handle is movable to an operative position to couple the drive shaft with the spindle for manually reeling in the line.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
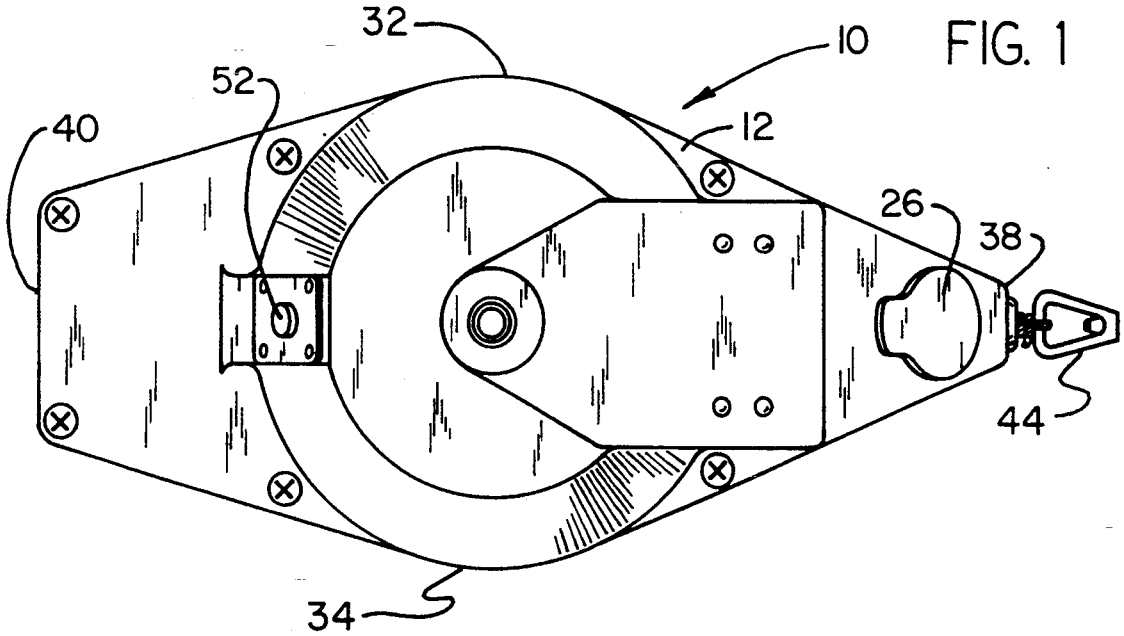
FIG. 1 is a side elevational view of the preferred embodiment of the battery powered chalk line system constructed in accordance with the principles of the present invention.
Figure 2:
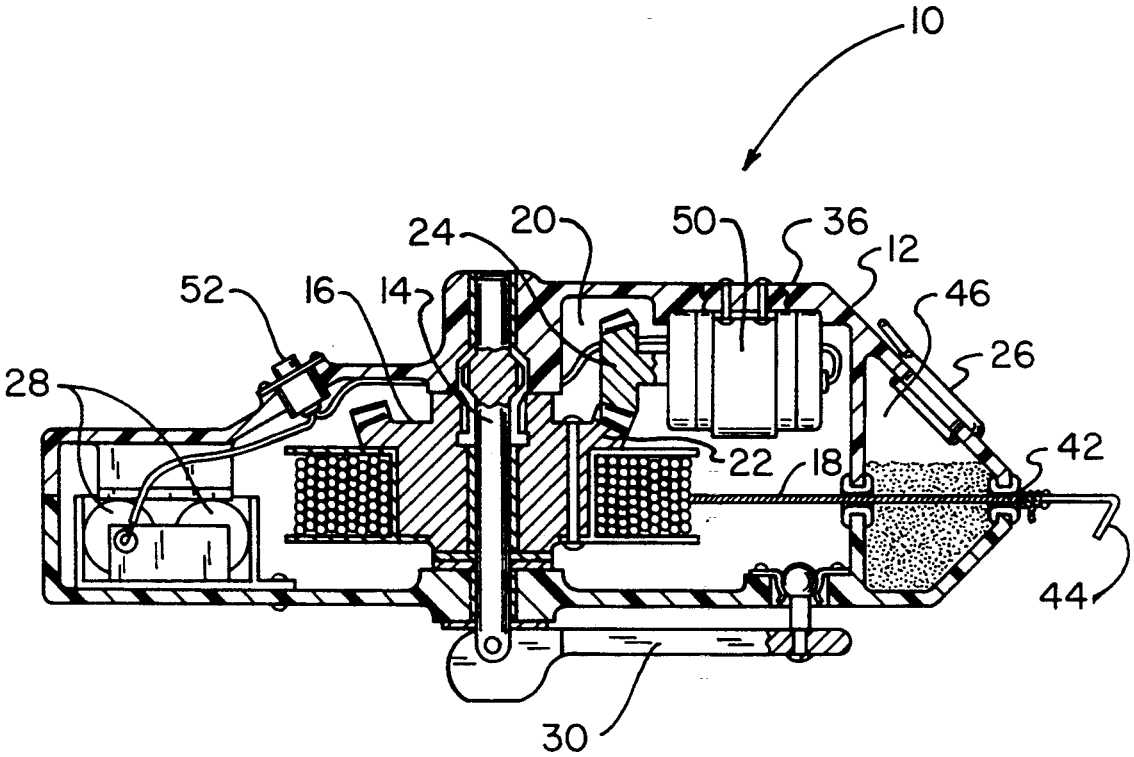
FIG. 2 is a sectional view taken centrally down the device of FIG. 1.
Figure 3:
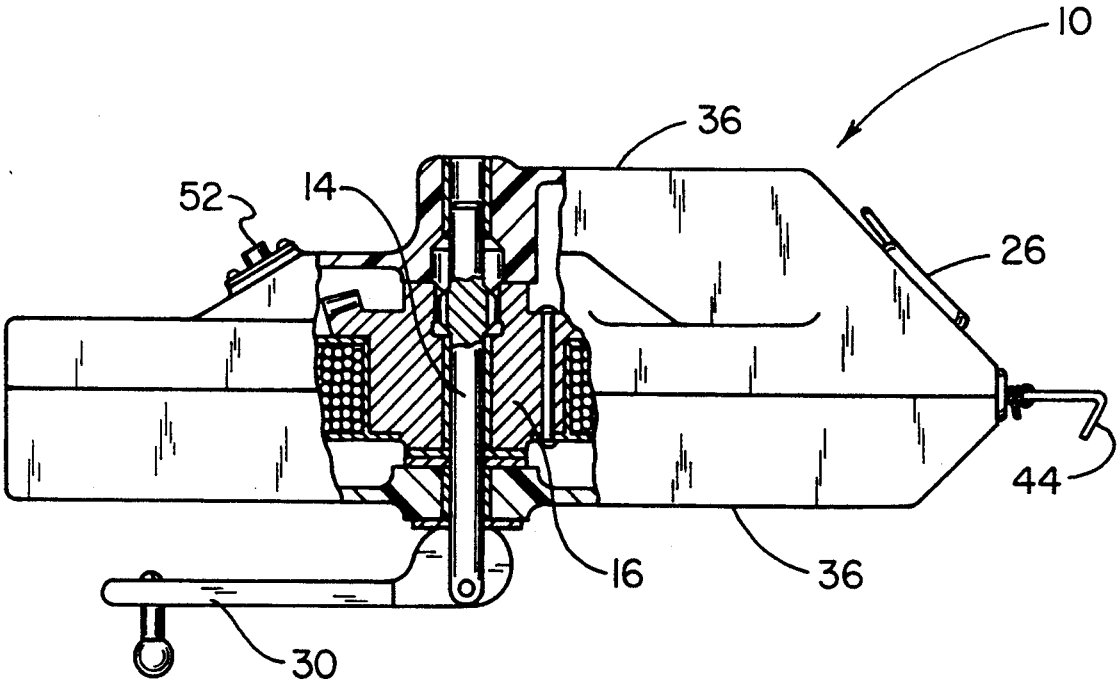
FIG. 3 is a partial sectional view similar to that of FIG. 2 but illustrating the handle in a manual retrieve position.
Figure 4:
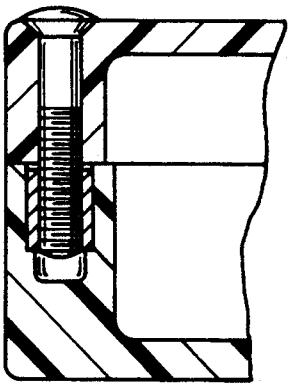
FIG. 4 is a sectional view of the coupling between the housing valves.

With reference now to the drawings, and in particular to FIG. 1 thereof, the preferred embodiment of the new and improved battery powered chalk line systems embodying the principles and concepts of the present invention and generally designated by the reference numeral 10 will be described.

Specifically, it will be noted in the FIGS. 1 through 4 that a new and improved battery powered chalk line system 10 is comprised of a plurality of separate components which are each individually configured and cooperable one with respect to the other to attain the intended objectives. In its broadest context, such components include a housing 12, drive shaft 14, spindle 16, chalk line 18, chamber 20, driven gear 22, drive gear 24, plug 26, batteries 28 and handle 30.

More specifically, the housing 12 is a rigid member formed of a material for impact resistance and rugged use through a wide variety of weathers and climates. It has a top face 32, bottom face 34, side face 36, as well as a front end 38 and a rear end 40. Located within such faces a chamber is formed therein.

Secured within the chamber 20 and supported by the side walls is a drive shaft 14. The drive shaft is mounted for rotation about its axis. Its length is sufficient to extent across the width of the chamber whereat its ends are journaled for rotation.

Secured on the drive shaft 14 is a spindle 16. The spindle has an axis of rotation which is the axis of rotation of the drive shaft 14. It is adapted to be selectively coupled to the drive shaft for rotation therewith or for rotation independent thereof. This is done in a manner to be described hereinafter.

Positioned on the spindle 16 is a string like chalk line 18. Such line is mounted on the spindle for being dispensed and retrieved with the rotation of the spindle with or without the rotation of the drive shaft. The chalk line 18 is adapted to extend through an aperture 42 in the front end of the housing. Located at the exterior free end of the chalk line is a hook 44. It is secured to the end of the line exterior of the housing 12. The size of the hook is such as to preclude its movement to within the housing. As such, the hook and the chalk line are always ready to be grasped and pulled for utility.

Located within the chamber of the housing is a cavity 46. Such chamber is located adjacent to the front end in proximity to the aperture. It is adapted to receive a quantity of chalk powder whereby for coating the chalk line whereby when the chalk line is pulled from the chamber, it will move in contact with the chalk powder. In this manner, any time the chalk line is pulled, it will be ready for marking a line on the adjacent surface as intended. Filling the cavity with new chalk periodically after use is done by a removable plug 26 which extends through an adjacent wall in the chamber and cavity for filling of supplemental chalk after use of the previously deposited chalk.

The next operative component of the system is a driven bevel gear 22. Such gear is formed with the spindle for rotation therewith. In association with the bevel gear is a motor 50 within the chamber. The motor has an output shaft with a drive bevel gear secured thereto for rotation therewith. Rotation of the drive gear thus rotates the driven gear to rotate the spindle to reel in the chalk line that may be exterior of the housing. Batteries 28 are located within the chamber for operative coupling to the motor to effect its actuations. A switch 52 is coupled between the batteries and the motor. The switch is on the external surface of the housing. In this manner, the user may activate or inactivate the motor at the discretion of the user for reeling in exposed chalk line.

Located exterior of the housing but pivotally ends rotationally secured thereto is a handle 30. The handle is mounted to one side of the drive shaft exterior of the housing. The handle is moveable about an axis perpendicular to the axis of the drive shaft. When pivoted about such axis, the handle may move to a first position locked with respect to the housing. This allows the free rotation of the spindle through the motor independent of the rotation of the drive shaft. Such orientation is used for automatically reeling in exposed chalk lines. The handle may also be pivoted to an operative position, rotation being perpendicular to the axis of the drive shaft. In such operative position, the handle is operatively couples the drive shaft with the spindle. This allows the user to manually rotate the drive shaft and spindle to manually reel in the exposed chalk line.

Figure 5:
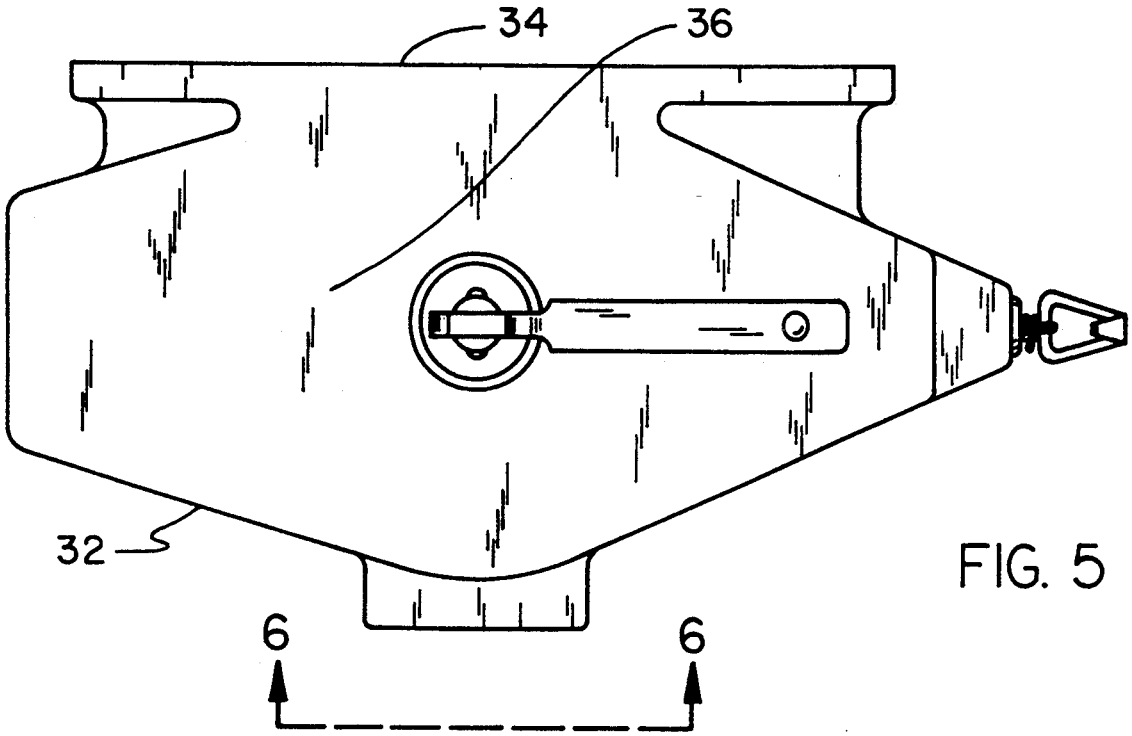
FIG. 5 is a side elevational view of a battery powered chalk line system constructed in accordance with an alternate embodiment of the invention.
Figure 6:
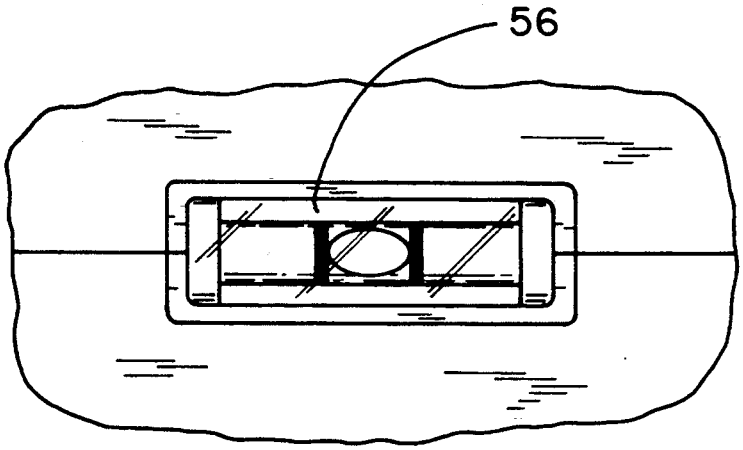
FIG. 6 is a top view of the device taken along line 6—6 of FIG. 5.

An alternate embodiment of the invention is shown in FIGS. 5 and 6. According to such embodiment, a bubble cartridge 56 is coupled to the exterior surface of the housing. Such bubble cartridge functions as a level device when mounted to the upper face of the housing. It may determine the flatness of an adjacent surface to be measured. The bubble cartridge is located on the top side with a planar surface parallel with the bubble cartridge on the lower surface of the housing.

Figure 7:
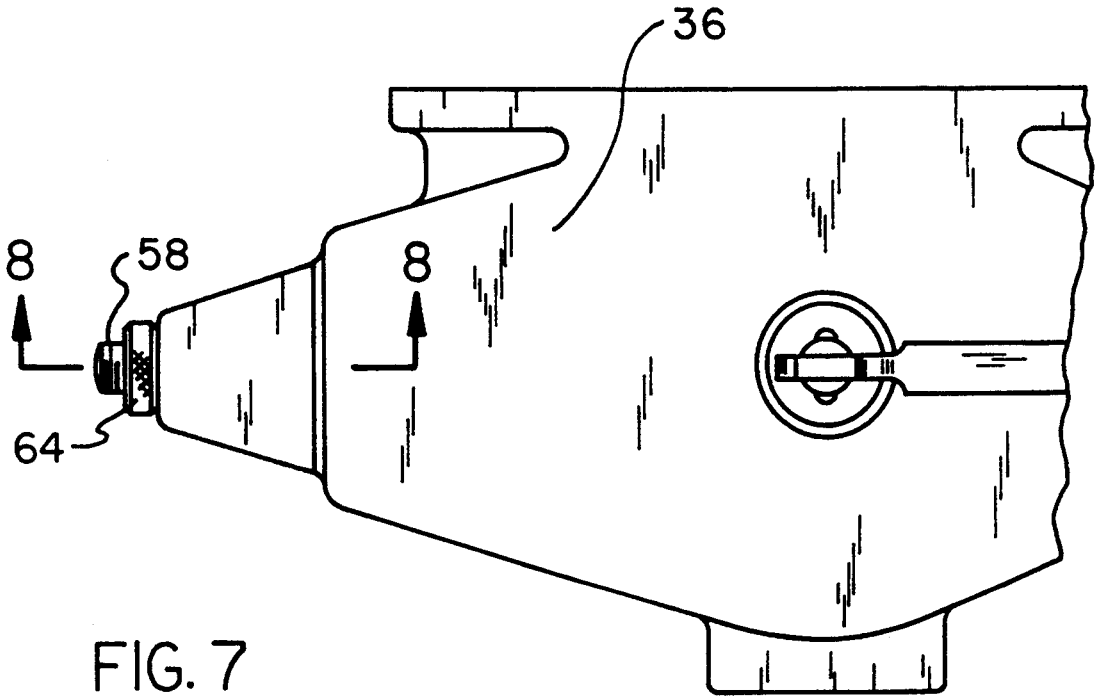
FIG. 7 is a side elevational view similar to FIG. 5 but illustrating an other alternate embodiment of the invention.
Figure 8:
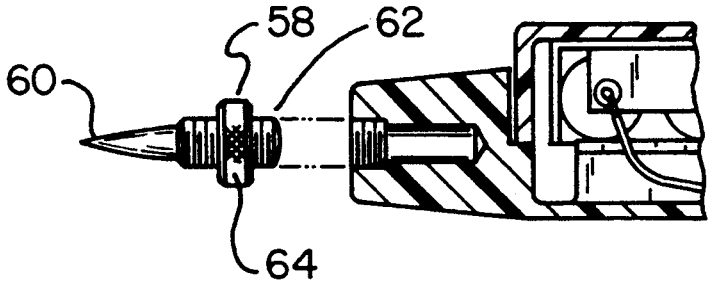
FIG. 8 is a cross sectional view taken along line 8—8 of FIG. 7.

The final alternate embodiment is shown in FIGS. 7 and 8. According to such embodiment, a scribe element 58 is provided. It has a pointed end 60 and a threaded end 62. A washer 64 is secured intermediate the extent of the threaded end and an associated recipient surface in the rear end of the housing for receiving the threads of the scribe elements. Due to the relationship of the parts and the washer, the scribe element may be located within the recipient surface with the point extending either internally or externally of the housing.

The present invention is an electrically operated reel which is used to wind up the line after it has been snapped. Chalk lines are made of ordinary twine, which is wound up on a reel, ready for use. They are used to mark a line between two points. As the line is unwound, it is coated with chalk, and one end is held or fastened at the first point. The other end is held or fastened tautly at the second point, with the line snugly against the surface. When the string is plucked, like that of a guitar, the line snaps against the surface, leaving a residue of the chalk, drawing a perfectly straight line between the two points. The line is then rewound on the reel, ready for the next use. This technique has been in use for many years and still is being employed by all of the trades, including carpenters, roofers, and other alike. Unlike strings and other devices which can get in the way, a chalk line does not interfere with movement, or the performance of work and is readily washed away, without leaving a mark.

The reel of the present invention is rotated by a geared assembly, driven by a small electrical motor which is powered by a self-contained storage battery. The unit is contained in an unbreakable plastic housing, with the operating switch mounted on the exterior. A D-clip protrudes from a small opening in the housing so the line can be withdrawn. The unit also can be operated by turning a handle which rotates the drive gear when the clutch is engaged.

The present invention is a valuable time saving device because it rewinds the line very rapidly. It also never leaves a mess in the area or on the operator.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved battery powered chalk line system comprising, in combination:

a housing formed of a rigid material having a top face, a bottom face and side walls as well as a front end and a rear end forming a chamber therein;

a drive shaft secured within the side walls for rotational movement and extending across the width of the chamber;

a spindle mounted on the shaft and selectively couplable for rotation therewith;

a chalk line mounted on the spindle for being dispensed and retrieved with the rotation of the spindle, the chalk line extending through an aperture in the front end of the housing with a hook secured to the end of the line exterior of the housing, the hook being sized to preclude its movement into the housing;

a cavity in the chamber adjacent to the front end in proximity to the aperture for coating the line with chalk powder as the line is moved therethrough;

a plug extending through a wall in the chamber in operative communication with the cavity for the filling of supplemental chalk after use;

a driven bevel gear formed with the spindle for rotation therewith;

a motor within the housing with an output shaft with a drive bevel gear secured thereto in meshing engagement with the driven bevel gear for rotation to rotate the driven bevel gear and the spindle to reel in the line;

batteries located within the chamber coupled to the motor with a switch coupled therebetween to activate and inactivate the motor at the discretion of the user;

a handle mounted to one end of the drive shaft exterior of the housing, the handle being movable to a first position locked with respect to the housing to allow rotation of the spindle through the motor independent of the drive shaft for the automatic reeling in the line, the handle being movable to an operative position to couple the drive shaft with the spindle for manual reeling in the line;

a bubble cartridge functioning as a level mounted to the top face of the housing, with the top face and bottom face being planar and parallel, to determine flatness of an adjacent surface; and a scribe element having a pointed end and a threaded end with a washer secured intermediate the extent of the threaded end and an associated recipient surface in the rear end of the housing for receiving the threads of the scribe element with the point extending either internally or externally.

2. A battery powered chalk line system comprising:

a housing formed of a rigid material having a top face, a bottom face and side walls as well as a front end and a rear end forming a chamber therein;

a drive shaft secured within the side walls for rotational movement and extending across the width of the chamber;

a spindle mounted on the shaft and selectively couplable for rotation therewith;

a chalk line mounted on the spindle for being dispensed and retrieved with the rotation of the spindle, the chalk line extending through an aperture in the front end of the housing with a hook secured to the end of the line exterior of the housing, the hook being sized to preclude its movement into the housing;

a cavity in the chamber adjacent to the front end in proximity to the aperture for coating the line with chalk powder as the line is moved therethrough;

a plug extending through a wall in the chamber in operative communication with the cavity for the filling of supplemental chalk after use;

a driven bevel gear formed with the spindle for rotation therewith;

a motor within the housing with an output shaft with a drive bevel gear secured thereto in meshing engagement with the driven bevel gear for rotation to rotate the driven bevel gear and the spindle to reel in the line;

batteries located within the chamber coupled to the motor with a switch coupled therebetween to activate and inactivate the motor at the discretion of the user; and a handle mounted to one end of the drive shaft exterior of the housing, the handle being movable to a first position locked with respect to the housing to allow rotation of the spindle through the motor independent of the drive shaft for the automatic reeling in the line, the handle being movable to an operative position to couple the drive shaft with the spindle for manual reeling in the line.

3. The device as set forth in claim 2 and further including:

a bubble cartridge functioning as a level mounted to the top face of the housing, with the top face and bottom face being planar and parallel, to determine flatness of an adjacent surface.

4. The device as set forth in claim 2 and further including:

a scribe element having a pointed end and a threaded end with a washer secured intermediate the extent of the threaded end and an associated recipient surface in the rear end of the housing for receiving the threads of the scribe element with the point extending either internally or externally.

* * * * *